US009829840B2

(12) United States Patent
Seto et al.

(10) Patent No.: US 9,829,840 B2
(45) Date of Patent: Nov. 28, 2017

(54) FIXING DEVICE AND IMAGE FORMING APPARATUS

(71) Applicants: Takashi Seto, Kanagawa (JP); Kenji Ishii, Kanagawa (JP); Susumu Matsusaka, Kanagawa (JP); Yasuhiko Ogino, Kanagawa (JP); Shohta Kobashigawa, Tokyo (JP); Kazuhito Kishi, Kanagawa (JP); Ippei Fujimoto, Kanagawa (JP); Kazunari Sawada, Tokyo (JP); Hiroshi Yoshinaga, Chiba (JP); Hiromasa Takagi, Tokyo (JP); Takamasa Hase, Tokyo (JP); Hiroshi Seo, Kanagawa (JP)

(72) Inventors: Takashi Seto, Kanagawa (JP); Kenji Ishii, Kanagawa (JP); Susumu Matsusaka, Kanagawa (JP); Yasuhiko Ogino, Kanagawa (JP); Shohta Kobashigawa, Tokyo (JP); Kazuhito Kishi, Kanagawa (JP); Ippei Fujimoto, Kanagawa (JP); Kazunari Sawada, Tokyo (JP); Hiroshi Yoshinaga, Chiba (JP); Hiromasa Takagi, Tokyo (JP); Takamasa Hase, Tokyo (JP); Hiroshi Seo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/011,886

(22) Filed: Feb. 1, 2016

(65) Prior Publication Data

US 2016/0231672 A1 Aug. 11, 2016

(30) Foreign Application Priority Data

Feb. 9, 2015 (JP) ..... 2015-023215
Dec. 11, 2015 (JP) ..... 2015-242716

(51) Int. Cl.
*G03G 15/20* (2006.01)

(52) U.S. Cl.
CPC ..... *G03G 15/2053* (2013.01); *G03G 15/2042* (2013.01); *G03G 2215/0132* (2013.01); *G03G 2215/2035* (2013.01)

(58) Field of Classification Search
CPC . G03G 15/2078; G03G 15/20; G03G 15/2082
See application file for complete search history.

(56) References Cited

U.S. PATENT DOCUMENTS 5,499,087 A * 3/1996 Hiraoka ..... G03G 15/2064 219/216
2004/0190954 A1* 9/2004 Nagasaki ..... G03G 15/2053 399/328

(Continued)

FOREIGN PATENT DOCUMENTS

JP 2002-311735 10/2002
JP 2011-164462 8/2011
JP 2014-178370 9/2014

*Primary Examiner* — Victor Verbitsky
(74) *Attorney, Agent, or Firm* — Oblon, McClelland, Maier & Neustadt, L.L.P.

(57) ABSTRACT

A fixing device includes a nip formation pad that presses against a pressure rotator via an endless belt to form a fixing nip between the belt and the pressure rotator, through which a recording medium bearing a toner image is conveyed. A fixing heater is disposed opposite at least a center span of a conveyance span of the belt in an axial direction thereof where the recording medium is conveyed to heat the belt. A first lateral end heater and a second lateral end heater are mounted on the nip formation pad and disposed opposite a first lateral end span and a second lateral end span of an inner circumferential surface of the belt in the axial direction thereof, respectively, to heat the belt. The second lateral end heater is electrically connected in series to the first lateral end heater.

19 Claims, 10 Drawing Sheets

(56) References Cited

U.S. PATENT DOCUMENTS

| | | | | |
|---|---|---|---|---|
| 2007/0235435 | A1* | 10/2007 | Haseba | H05B 3/0095 219/216 |
| 2011/0116848 | A1* | 5/2011 | Yamaguchi | G03G 15/2064 399/329 |
| 2011/0200368 | A1 | 8/2011 | Yamaguchi et al. | |
| 2012/0093548 | A1* | 4/2012 | Kimura | G03G 15/2017 399/329 |
| 2013/0164059 | A1 | 6/2013 | Takagi et al. | |
| 2013/0170879 | A1 | 7/2013 | Yoshinaga et al. | |
| 2013/0183070 | A1 | 7/2013 | Kawata et al. | |
| 2013/0183071 | A1 | 7/2013 | Iwaya et al. | |
| 2015/0063884 | A1 | 3/2015 | Iwaya et al. | |
| 2015/0286175 | A1* | 10/2015 | Okamoto | G03G 15/2042 399/69 |

* cited by examiner

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2015-023215, filed on Feb. 9, 2015, and 2015-242716, filed on Dec. 11, 2015, in the Japanese Patent Office, the entire disclosure of each of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a flexible endless belt rotatable in a predetermined direction of rotation and a pressure rotator disposed opposite the belt. A nip formation pad presses against the pressure rotator via the belt to form a fixing nip between the belt and the pressure rotator, through which a recording medium bearing a toner image is conveyed. A fixing heater is disposed opposite at least a center span of a conveyance span of the belt in an axial direction thereof where the recording medium is conveyed to heat the belt. A first lateral end heater is mounted on the nip formation pad and disposed opposite a first lateral end span of an inner circumferential surface of the belt in the axial direction thereof to heat the belt. A second lateral end heater is mounted on the nip formation pad and disposed opposite a second lateral end span of the inner circumferential surface of the belt in the axial direction thereof to heat the belt. The second lateral end heater is electrically connected in series to the first lateral end heater.

This specification further describes an improved image forming apparatus. In one exemplary embodiment, the image forming apparatus includes an image bearer that bears a toner image and a fixing device disposed downstream from the image bearer in a recording medium conveyance direction to fix the toner image on a recording medium. The fixing device includes a flexible endless belt rotatable in a predetermined direction of rotation and a pressure rotator disposed opposite the belt. A nip formation pad presses against the pressure rotator via the belt to form a fixing nip between the belt and the pressure rotator, through which the recording medium bearing the toner image is conveyed. A fixing heater is disposed opposite at least a center span of a conveyance span of the belt in an axial direction thereof where the recording medium is conveyed to heat the belt. A first lateral end heater is mounted on the nip formation pad and disposed opposite a first lateral end span of an inner circumferential surface of the belt in the axial direction thereof to heat the belt. A second lateral end heater is mounted on the nip formation pad and disposed opposite a second lateral end span of the inner circumferential surface of the belt in the axial direction thereof to heat the belt. The second lateral end heater is electrically connected in series to the first lateral end heater.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
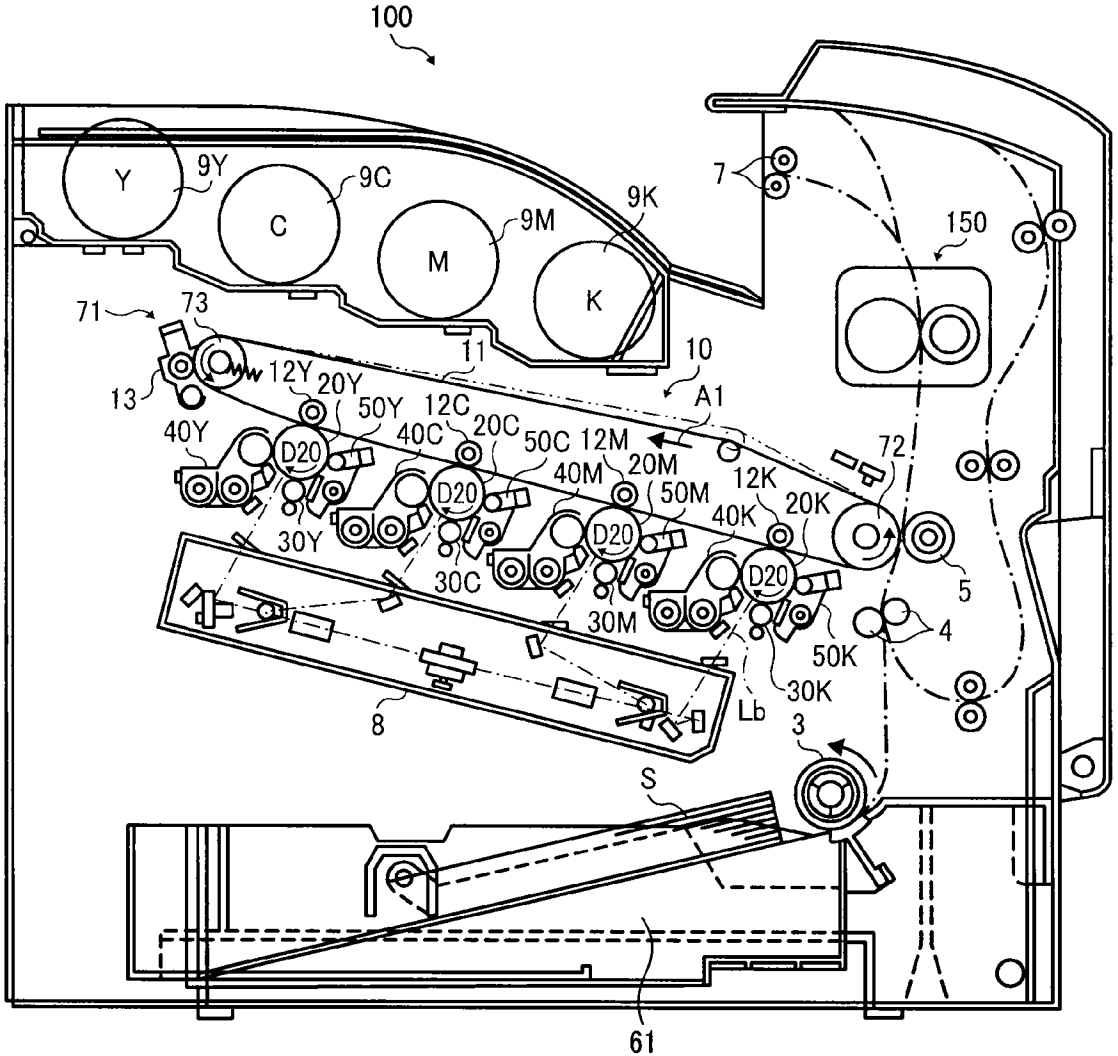
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 100 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical sectional view of the image forming apparatus 100. The image forming apparatus 100 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 100 is a color printer that forms color and monochrome toner images on a recording medium by electrophotography. Alternatively, the image forming apparatus 100 may be a monochrome printer that forms a monochrome toner image on a recording medium.

A description is provided of a construction and an operation of the image forming apparatus 100.

The image forming apparatus 100 is a color printer employing a tandem system in which a plurality of image forming devices for forming toner images in a plurality of colors, respectively, is aligned in a rotation direction of an intermediate transfer belt.

The image forming apparatus 100 includes four photoconductive drums 20Y, 20C, 20M, and 20K serving as image bearers that bear yellow, cyan, magenta, and black toner images in separation colors, respectively, that is, yellow, cyan, magenta, and black. The yellow, cyan, magenta, and black toner images formed on the photoconductive drums 20Y, 20C, 20M, and 20K as visible images, respectively, are primarily transferred successively onto an intermediate transfer belt 11 serving as an intermediate transferor disposed opposite the photoconductive drums 20Y, 20C, 20M, and 20K as the intermediate transfer belt 11 rotates in a rotation direction A1 such that the yellow, cyan, magenta, and black toner images are superimposed on a same position on the intermediate transfer belt 11 in a primary transfer process. Thereafter, the yellow, cyan, magenta, and black toner images superimposed on the intermediate transfer belt 11 are secondarily transferred onto a sheet S serving as a recording medium collectively in a secondary transfer process. Each of the photoconductive drums 20Y, 20C, 20M, and 20K is surrounded by image forming components that form the yellow, cyan, magenta, and black toner images on the photoconductive drums 20Y, 20C, 20M, and 20K as they rotate clockwise in FIG. 1 in a rotation direction D20.

Taking the photoconductive drum 20K that forms the black toner image, the following describes a construction of components that form the black toner image. The photoconductive drum 20K is surrounded by a charger 30K, a developing device 40K, a primary transfer roller 12K, and a cleaner 50K in this order in the rotation direction D20 of the photoconductive drum 20K. The photoconductive drums 20Y, 20C, and 20M are also surrounded by chargers 30Y, 30C, and 30M, developing devices 40Y, 40C, and 40M, primary transfer rollers 12Y, 12C, and 12M, and cleaners 50Y, 50C, and 50M in this order in the rotation direction D20 of the photoconductive drums 20Y, 20C, and 20M, respectively. The charger 30K uniformly changes an outer circumferential surface of the photoconductive drum 20K. An optical writing device 8 optically writes an electrostatic latent image on the charged outer circumferential surface of the photoconductive drum 20K according to image data sent from an external device such as a client computer. The developing device 40K visualizes the electrostatic latent image as a black toner image.

As the intermediate transfer belt 11 rotates in the rotation direction A1, the yellow, cyan, magenta, and black toner images formed on the photoconductive drums 20Y, 20C, 20M, and 20K, respectively, are primarily transferred successively onto the intermediate transfer belt 11, thus being superimposed on the same position on the intermediate transfer belt 11 and formed into a color toner image. In the primary transfer process, the primary transfer rollers 12Y, 12C, 12M, and 12K disposed opposite the photoconductive drums 20Y, 20C, 20M, and 20K via the intermediate transfer belt 11, respectively, apply a primary transfer bias to the photoconductive drums 20Y, 20C, 20M, and 20K successively from the upstream photoconductive drum 20Y to the downstream photoconductive drum 20K in the rotation direction A1 of the intermediate transfer belt 11. The photoconductive drums 20Y, 20C, 20M, and 20K are aligned in this order in the rotation direction A1 of the intermediate transfer belt 11. The photoconductive drums 20Y, 20C, 20M, and 20K are located in four image forming stations that form the yellow, cyan, magenta, and black toner images, respectively.

The image forming apparatus 100 includes the four image forming stations that form the yellow, cyan, magenta, and black toner images, respectively, an intermediate transfer belt unit 10, a secondary transfer roller 5, an intermediate transfer belt cleaner 13, and the optical writing device 8. The intermediate transfer belt unit 10 is situated above and disposed opposite the photoconductive drums 20Y, 20C, 20M, and 20K. The intermediate transfer belt unit 10 incorporates the intermediate transfer belt 11 and the primary transfer rollers 12Y, 12C, 12M, and 12K. The secondary transfer roller 5 serves as a secondary transferor disposed opposite the intermediate transfer belt 11 and driven and rotated in accordance with rotation of the intermediate transfer belt 11. The intermediate transfer belt cleaner 13 is disposed opposite the intermediate transfer belt 11 to clean the intermediate transfer belt 11. The optical writing device 8 is situated below and disposed opposite the four image forming stations.

The optical writing device 8 includes a semiconductor laser serving as a light source, a coupling lens, an fθ lens, a troidal lens, a deflection mirror, and a rotatable polygon mirror serving as a deflector. The optical writing device 8 emits light beams Lb corresponding to the yellow, cyan, magenta, and black toner images to be formed on the photoconductive drums 20Y, 20C, 20M, and 20K thereto, forming electrostatic latent images on the photoconductive drums 20Y, 20C, 20M, and 20K, respectively. FIG. 1 illustrates the light beam Lb irradiating the photoconductive drum 20K. Similarly, light beams irradiate the photoconductive drums 20Y, 20C, and 20M, respectively.

The image forming apparatus 100 further includes a sheet feeder 61 and a registration roller pair 4. The sheet feeder 61, disposed in a lower portion of the image forming apparatus 100, incorporates a paper tray that loads a plurality of sheets S to be conveyed to a secondary transfer nip formed between the intermediate transfer belt 11 and the secondary transfer roller 5. The registration roller pair 4 serving as a conveyor conveys the sheet S conveyed from the sheet feeder 61 to the secondary transfer nip formed between the intermediate transfer belt 11 and the secondary transfer roller 5 at a predetermined time when the yellow, cyan, magenta, and black toner images superimposed on the intermediate transfer belt 11 reach the secondary transfer nip. The image forming apparatus 100 further includes a sensor for detecting that a leading edge of the sheet S reaches the registration roller pair 4.

The secondary transfer roller 5 secondarily transfers the color toner image formed on the intermediate transfer belt 11 onto the sheet S as the sheet S is conveyed through the secondary transfer nip. The sheet S bearing the color toner image is conveyed to a fixing device 150 where the color toner image is fixed on the sheet S under heat and pressure. An output roller pair 7 ejects the sheet S bearing the fixed color toner image onto an output tray disposed atop the image forming apparatus 100. In an upper portion of the image forming apparatus 100 and below the output tray are toner bottles 9Y, 9C, 9M, and 9K containing fresh yellow, cyan, magenta, and black toners, respectively.

The intermediate transfer belt unit 10 includes a driving roller 72 and a driven roller 73 over which the intermediate transfer belt 11 is looped, in addition to the intermediate transfer belt 11 and the primary transfer rollers 12Y, 12C, 12M, and 12K. Since the driven roller 73 also serves as a tension applicator that applies tension to the intermediate transfer belt 11, a biasing member (e.g., a spring) biases the driven roller 73 against the intermediate transfer belt 11. The intermediate transfer belt unit 10, the primary transfer rollers 12Y, 12C, 12M, and 12K, the secondary transfer roller 5, and the intermediate transfer belt cleaner 13 constitute a transfer device 71. The sheet feeder 61 includes a feed roller 3 that contacts an upper side of an uppermost sheet S of the plurality of sheets S loaded on the paper tray of the sheet feeder 61. As the feed roller 3 is driven and rotated counterclockwise in FIG. 1, the feed roller 3 feeds the uppermost sheet S to the registration roller pair 4.

The intermediate transfer belt cleaner 13 of the transfer device 71 includes a cleaning brush and a cleaning blade disposed opposite the intermediate transfer belt 11 to come into contact with the intermediate transfer belt 11. The cleaning brush and the cleaning blade scrape a foreign substance such as residual toner particles off the intermediate transfer belt 11, removing the foreign substance from the intermediate transfer belt 11 and thereby cleaning the intermediate transfer belt 11. The intermediate transfer belt cleaner 13 further includes a waste toner conveyer that conveys the residual toner particles removed from the intermediate transfer belt 11.

Figure 2:
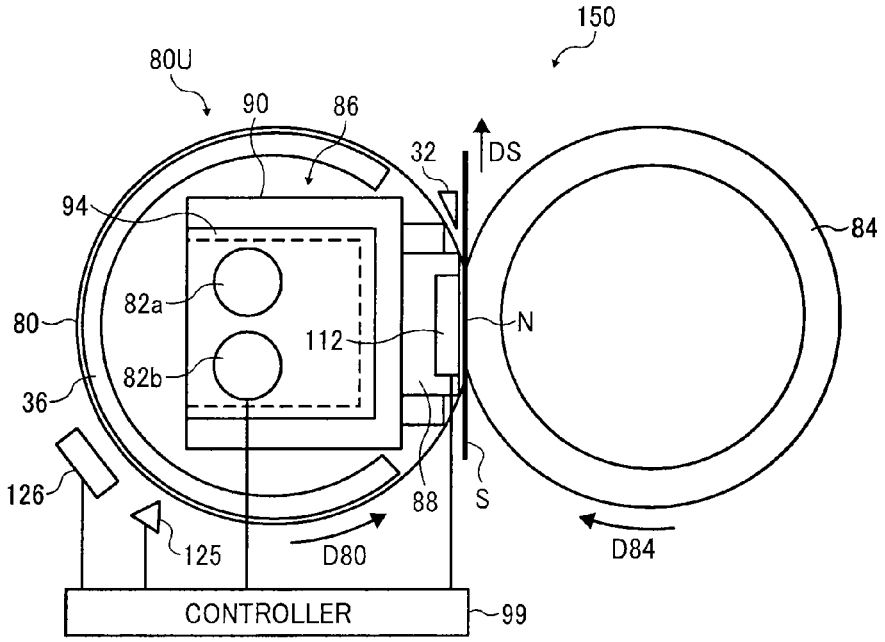
FIG. 2 is a schematic vertical sectional view of a fixing device incorporated in the image forming apparatus shown in FIG. 1.

With reference to FIG. 2, a description is provided of a configuration of the fixing device 150 incorporated in the image forming apparatus 100 described above.

FIG. 2 is a schematic vertical sectional view of the fixing device 150. As shown in FIG. 2, the fixing device 150 (e.g., a fuser or a fusing unit) includes a thin, flexible, endless fixing belt 80, serving as an endless belt or a fixing rotator, formed into a loop and rotatable in a rotation direction D80 and a pressure roller 84 serving as a pressure rotator disposed opposite the fixing belt 80 and rotatable in a rotation direction D84. Inside the loop formed by the fixing belt 80 is a nip formation assembly 86 (e.g., a nip formation unit) that forms a fixing nip N between the fixing belt 80 and the pressure roller 84, through which the sheet S is conveyed.

A detailed description is now given of a construction of the nip formation assembly 86.

The nip formation assembly 86 includes a nip formation pad 88, a lateral end heater 112, and a stay 90. The nip formation pad 88, disposed inside the loop formed by the fixing belt 80 and disposed opposite the pressure roller 84, presses against the pressure roller 84 via the fixing belt 80 to form the fixing nip N between the fixing belt 80 and the pressure roller 84. The lateral end heater 112 serving as a lateral end heater or a lateral end heat source is mounted on each lateral end of the nip formation pad 88 in a longitudinal direction thereof parallel to an axial direction of the fixing belt 80. The stay 90 supports the nip formation pad 88 against pressure from the pressure roller 84.

Figure 3:
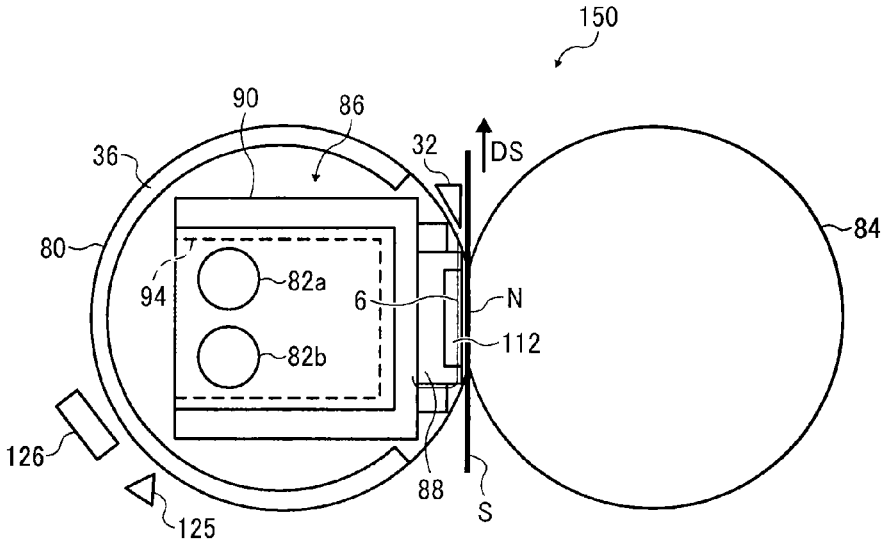
FIG. 3 is a schematic vertical sectional view of the fixing device shown in FIG. 2 illustrating a slide sheet.

FIG. 3 is a schematic vertical sectional view of the fixing device 150 illustrating a slide sheet. As shown in FIG. 3, an inner circumferential surface of the fixing belt 80 slides over the nip formation pad 88 via a low-friction sheet 6 serving as a slide sheet. The low-friction sheet 6 is applied with a lubricant such as fluorine grease and silicone oil to decrease a slide torque of the fixing belt 80. Alternatively, the nip formation pad 88 may contact the inner circumferential surface of the fixing belt 80 directly without the low-friction sheet 6 sandwiched between the nip formation pad 88 and the fixing belt 80.

The stay 90 has a box shape with an opening opposite the fixing nip N. Two halogen heaters 82*a* and 82*b* serving as a fixing heater or a fixing heat source are disposed inside the box of the stay 90. The halogen heaters 82*a* and 82*b* emit light that irradiates the inner circumferential surface of the fixing belt 80 directly through the opening of the stay 90, heating the fixing belt 80 with radiation heat. A platy reflector 94 is mounted on an interior surface of the stay 90 to reflect light radiated from the halogen heaters 82*a* and 82*b* toward the fixing belt 80 so as to improve heating efficiency of the halogen heaters 82*a* and 82*b* to heat the fixing belt 80. The reflector 94 prevents light from the halogen heaters 82*a* and 82*b* from heating the stay 90, suppressing waste of energy. Alternatively, instead of the reflector 94, the interior surface of the stay 90 may be treated with insulation or mirror finish to reflect light radiated from the halogen heaters 82*a* and 82*b* toward the fixing belt 80.

A detailed description is now given of a construction of the pressure roller 84.

Figure 4:
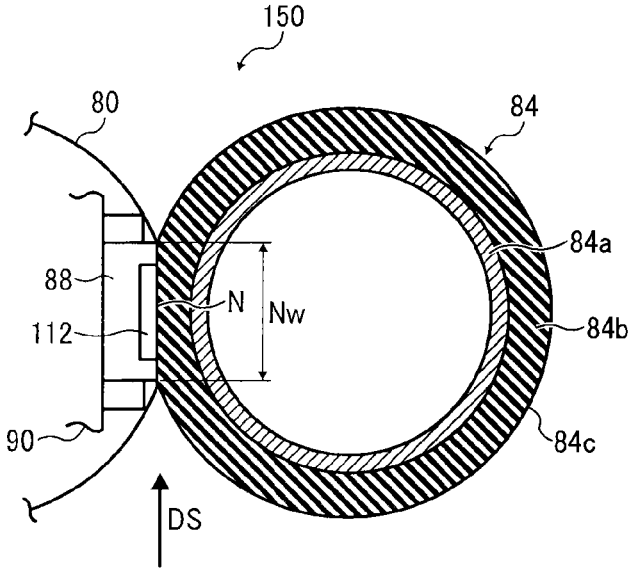
FIG. 4 is a partial vertical sectional view of the fixing device shown in FIG. 2.

FIG. 4 is a partial vertical sectional view of the fixing device 150. As shown in FIG. 4, the pressure roller 84 is constructed of a hollow metal roller 84*a*, an elastic layer 84*b* coating an outer circumferential surface of the metal roller 84*a* and being made of silicone rubber, and a release layer 84*c* coating an outer circumferential surface of the elastic layer 84*b*. The release layer 84*c*, having a layer thickness in a range of from 5 micrometers to 50 micrometers, is made of perfluoroalkoxy fluoro resin (PFA) or polytetrafluoroethylene (PTFE) to facilitate separation of the sheet S from the pressure roller 84. As a driving force generated by a driver (e.g., a motor) situated inside the image forming apparatus 100 depicted in FIG. 1 is transmitted to the pressure roller 84 through a gear train, the pressure roller 84 rotates in the rotation direction D84 as shown in FIG. 2. Alternatively, the driver may also be connected to the fixing belt 80 to drive and rotate the fixing belt 80. A spring or the like biases the pressure roller 84 against the fixing belt 80. As the elastic layer 84*b* of the pressure roller 84 is pressed and deformed, the pressure roller 84 produces the fixing nip N having a predetermined length Nw in a sheet conveyance direction DS as shown in FIG. 4. Alternatively, the pressure roller 84 may be a solid roller. However, a hollow roller has a decreased thermal capacity. Further, a heater or a heat source such as a halogen heater may be disposed inside the pressure roller 84. The elastic layer 84*b* may be made of solid rubber. Alternatively, if no heater is situated inside the pressure roller 84, the elastic layer 84*b* may be made of sponge rubber. The sponge rubber is more preferable than the solid rubber because the sponge rubber has an increased insulation that draws less heat from the fixing belt 80.

A detailed description is now given of a construction of the fixing belt 80.

The fixing belt 80 is an endless belt or film having a layer thickness in a range of from 30 micrometers to 50 micrometers and made of metal such as nickel and SUS stainless steel or resin such as polyimide. The fixing belt 80 is constructed of a base layer and a release layer. The release layer constituting an outer surface layer is made of PFA, PTFE, or the like to facilitate separation of toner of a toner image on the sheet S from the fixing belt 80, thus preventing the toner of the toner image from adhering to the fixing belt 80. Optionally, an elastic layer may be sandwiched between the base layer and the release layer and made of silicone rubber or the like. If the fixing belt 80 does not incorporate the elastic layer, the fixing belt 80 has a decreased thermal capacity that improves fixing property of being heated quickly to a desired fixing temperature at which the toner image is fixed on the sheet S. However, as the pressure roller 84 and the fixing belt 80 sandwich and press the unfixed toner image on the sheet S passing through the fixing nip N, slight surface asperities of the fixing belt 80 may be transferred onto the toner image on the sheet S, resulting in variation in gloss of the solid toner image on the sheet S.

To address this circumstance, the elastic layer made of silicone rubber has a thickness not smaller than 100 micrometers. As the elastic layer deforms, the elastic layer absorbs slight surface asperities of the fixing belt 80, suppressing variation in gloss of the toner image on the sheet S. As shown in FIG. 2, as the pressure roller 84 rotates in the rotation direction D84, the fixing belt 80 rotates in the rotation direction D80 in accordance with rotation of the pressure roller 84 by friction therebetween. At the fixing nip N, the fixing belt 80 rotates as it is sandwiched between the pressure roller 84 and the nip formation pad 88; at a circumferential span of the fixing belt 80 other than the fixing nip N, the fixing belt 80 rotates while the fixing belt 80 is supported at each lateral end in the axial direction thereof to retain a tubular shape. Thus, the fixing belt 80 is retained circular in cross-section stably. As shown in FIG. 2, a separator 32 is disposed downstream from the fixing nip N in the sheet conveyance direction DS to separate the sheet S from the fixing belt 80.

According to this exemplary embodiment, as shown in FIGS. 2 to 4, the fixing nip N is planar. Alternatively, the fixing nip N may define a curve projecting toward the fixing belt 80 to produce a recess in the fixing belt 80 in cross-section or other shapes. If the fixing nip N defines the recess in the fixing belt 80, the recessed fixing nip N directs the leading edge of the sheet S toward the pressure roller 84 as the sheet S is ejected from the fixing nip N, facilitating separation of the sheet S from the fixing belt 80 and suppressing jamming of the sheet S. In this case, a nip formation face of the nip formation pad 88 is contoured into the recess. Similarly, a fixing belt side face of the lateral end heater 112 coupled with the nip formation pad 88 may be contoured along the recessed nip formation face of the nip formation pad 88.

A detailed description is now given of a configuration of the stay 90.

The stay 90 supports the nip formation pad 88 against pressure from the pressure roller 84 to prevent bending of the nip formation pad 88 and produce the even length Nw of the fixing nip N in the sheet conveyance direction DS throughout the entire width of the fixing belt 80 in the axial direction thereof. According to this exemplary embodiment, the pressure roller 84 is pressed against the fixing belt 80 to form the fixing nip N. Alternatively, the nip formation assembly 86 may be pressed against the pressure roller 84 to from the fixing nip N. The stay 90 has a mechanical strength great enough to support the nip formation pad 88 to prevent bending of the nip formation pad 88. The stay 90 is made of metal such as stainless steel and iron, metallic oxide such as ceramic, or the like. The fixing belt 80 and the components disposed inside the loop formed by the fixing belt 80, that is, the halogen heaters 82*a* and 82*b*, the nip formation pad 88, the lateral end heater 112, the stay 90, and the reflector 94, may constitute a belt unit 80U separably coupled with the pressure roller 84.

Figure 5:
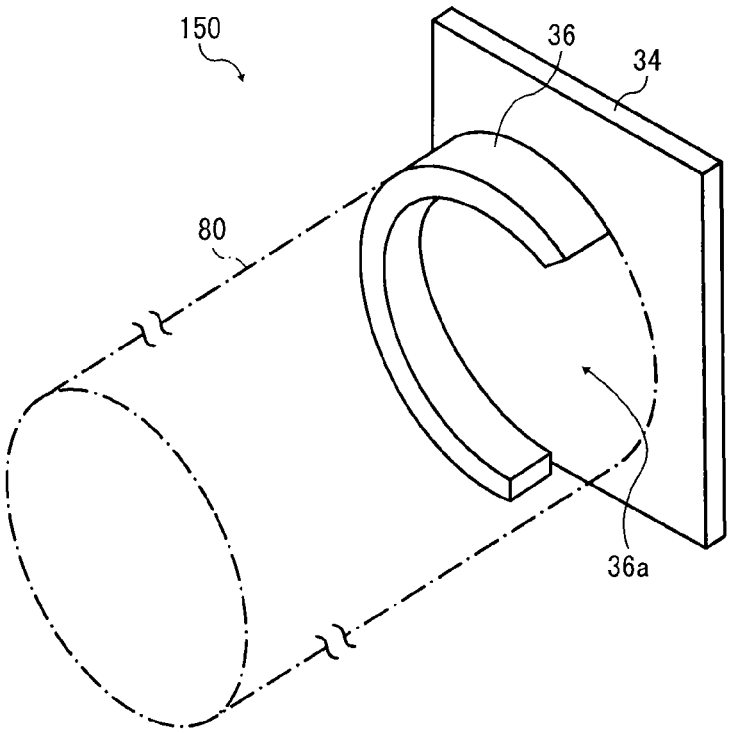
FIG. 5 is a partial perspective view of the fixing device shown in FIG. 2.

FIG. 5 is a partial perspective view of the fixing device 150. As shown in FIG. 5, both lateral ends of the fixing belt 80 in the axial direction thereof are rotatably supported by flanges 36, respectively. Each of the flanges 36 serves as a support projecting from a side plate 34 in the axial direction of the fixing belt 80. Although FIG. 5 illustrates the flange 36 and the side plate 34 situated at one lateral end of the fixing belt 80 in the axial direction thereof, the flange 36 and the side plate 34 are also situated at another lateral end of the fixing belt 80 in the axial direction thereof. The flange 36 that guides each lateral end of the fixing belt 80 in the axial direction thereof has an outer diameter substantially equivalent to an inner diameter of the fixing belt 80. The flange 36 projects inboard from a lateral edge of the fixing belt 80 by a length in a range of from 5 mm to 10 mm in the axial direction of the fixing belt 80. The flanges 36 guide the fixing belt 80 even when the fixing belt 80 rotates, retaining the fixing belt 80 to be circular in cross-section. The flange 36 includes a slit 36*a* disposed opposite the fixing nip N to place the nip formation assembly 86 at a predetermined position. The stay 90 depicted in FIG. 2 has a width that spans the entire width of the fixing belt 80 in the axial direction thereof. Both lateral ends of the stay 90 in the axial direction of the fixing belt 80 are fixedly mounted on the side plates 34, respectively, thus being supported and positioned by the side plates 34.

Figure 6:
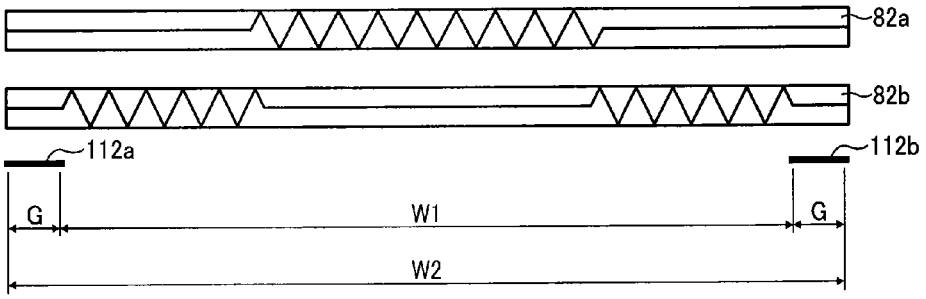
FIG. 6 is a plan view of halogen heaters and lateral end heaters incorporated in the fixing device shown in FIG. 2.

FIG. 6 is a plan view of the halogen heaters 82*a* and 82*b* illustrating a light distribution of the halogen heaters 82*a* and 82*b* and a positional relation between the halogen heaters 82*a* and 82*b* and a plurality of lateral end heaters 112*a* and 112*b*. FIG. 6 illustrates a width W1 of an A3 size sheet in portrait orientation in the axial direction of the fixing belt 80 and a width W2 of an A3 extension size sheet and a 13-inch size sheet in portrait orientation in the axial direction of the fixing belt 80. As shown in FIG. 6, the halogen heater 82*a* is a center heater having a dense light distribution at a center span of the halogen heater 82*a* disposed opposite a center span of the fixing belt 80 in the axial direction thereof where a small sheet S having a decreased width in the axial direction of the fixing belt 80 is conveyed over the fixing belt 80. Conversely, the halogen heater 82*b* is an outboard heater having a dense light distribution at each lateral end span of the halogen heater 82*b* disposed outboard from the halogen heater 82*a* and disposed opposite each lateral end span of the fixing belt 80 in the axial direction thereof where a medium sheet S having a medium width (e.g., an A3 size sheet) in the axial direction of the fixing belt 80 is conveyed over the fixing belt 80. As the small sheet S is conveyed over the fixing belt 80, the halogen heater 82*a* is powered on and the halogen heater 82*b* is not powered on, thus preventing each lateral end span of the fixing belt 80 in the axial direction thereof where the small sheet S is not conveyed from being heated unnecessarily.

A description is provided of a configuration of a first comparative fixing device incorporating a center heater equivalent to the halogen heater 82*a* and a lateral end heater equivalent to the halogen heater 82*b* depicted in FIG. 6.

As a small sheet S is conveyed through the fixing nip N, the center heater having a center dense light distribution is powered on. As a medium sheet S is conveyed through the fixing nip N, the lateral end heater having a lateral end dense light distribution is powered on together with the center heater. The center heater and the lateral end heater are powered on and off properly to heat sheets S of various sizes.

Taking the sizes of the sheets S and the frequency with which the sheets S are conveyed, sheets S up to the A3 size sheet are used frequently. The A3 size sheet is conveyed through the fixing nip N in portrait orientation. An A4 size sheet and a letter (LT) size sheet that are used with an increased frequency are generally conveyed in landscape orientation to enhance productivity. To address this circumstance, the center heater and the lateral end heater produce a heating span of about 300 mm in the axial direction of the fixing belt 80 that is great enough to heat 99 percent or more of the sizes of sheets S. On the other hand, the center heater and the lateral end heater are requested to heat large sheets S greater than the A3 size sheet in the axial direction of the fixing belt 80 such as the A3 extension size sheet and the 13-inch sheet although the large sheets S are used infrequently.

If a plurality of halogen heaters is used as the center heater and the lateral end heater, respectively, the plurality of halogen heaters used to heat the small sheet S is situated inside the loop formed by the fixing belt 80 or a fixing roller having a diameter of about 30 mm. Accordingly, the number of the halogen heaters is limited. To address this circumstance, the lateral end heater having the lateral end dense light distribution may be elongated to span a width of the large sheet S greater than a width of the A3 size sheet in the axial direction of the fixing belt 80. As described above, the center heater and the lateral end heater heat the heating span of about 300 mm of the fixing belt 80 in the axial direction thereof frequently. However, if the elongated lateral end heater is employed, the elongated lateral end heater may heat an elongated heating span of about 330 mm of the fixing belt 80 in the axial direction thereof, wasting energy used to heat a differential between the heating span of about 300 mm and the elongated heating span of about 330 mm. When the A3 size sheet in portrait orientation or the A4 size sheet in landscape orientation is conveyed through the fixing nip N, each lateral end of the elongated heating span of the fixing belt 80 in the axial direction thereof that corresponds to the differential between the heating span of about 300 mm and the elongated heating span of about 330 mm may overheat. In order to cool the overheated lateral end of the fixing belt 80, productivity defined by a conveyance speed of the sheets S may be degraded or a fan may be installed. If a reflection plate is interposed between the lateral end heater and the fixing belt 80, each lateral end of the lateral end heater in the axial direction of the fixing belt 80 may overheat. To address this circumstance, a second comparative fixing device is proposed.

The second comparative fixing device includes a thin, flexible endless belt to be heated quickly to a fixing temperature at which a toner image is fixed on a sheet S and a nip formation unit located inside a loop formed by the endless belt. The nip formation unit presses against a pressure roller via the endless belt to form a fixing nip between the endless belt and the pressure roller. A plurality of halogen heaters having different light distributions, respectively, is situated inside the loop formed by the endless belt. A plurality of lateral end heaters is disposed opposite both lateral end spans of the endless belt in an axial direction thereof, respectively, and upstream from the fixing nip in a rotation direction of the endless belt so as to heat an increased heating span of the endless belt corresponding to the width of the large sheet S in the axial direction of the endless belt. The lateral end heaters contact an inner circumferential surface or an outer circumferential surface of the endless belt. The lateral end heaters heat the increased heating span of the endless belt corresponding to the width of the large sheet S in the axial direction of the endless belt with a simple construction not incorporating an extra halogen heater directed to the large sheet S.

The lateral end heaters are disposed opposite both lateral end spans of the endless belt in the axial direction thereof, respectively. Accordingly, the lateral end heaters are powered on and off simultaneously, complicating a control circuit that controls the lateral end heaters. Even if one of the lateral end heaters suffers from failure, another one of the lateral end heaters is energized and is susceptible to electric failure.

A width of the A3 size sheet in portrait orientation and a width of the A4 size sheet in landscape orientation are smaller than a width of the A3 extension size sheet in portrait orientation (e.g., 329 mm) and a width of the 13-inch sheet in portrait orientation (e.g., 330 mm) by a differential in a range of from 32 mm to 33 mm, respectively. Accordingly, if the fixing device 150 is configured to heat each lateral end span of the fixing belt 80 in the axial direction thereof, that is, if the fixing device 150 is configured to heat a half of the differential in range of from 32 mm to 33 mm, that is, a span in a range of from 16.0 mm to 16.5 mm, the maximum width of sheets S available in the fixing device 150 increases from the width W1 of the A3 size sheet to the width W2 of the A3 extension size sheet or the like as shown in FIG. 6. In other words, if the fixing device 150 is configured to heat each outboard span, that is, each lateral end, of the fixing belt 80 disposed opposite an outboard span of the halogen heater 82*b* that is outboard from each lateral end span of the halogen heater 82*b* in the axial direction of the fixing belt 80 and does not have the dense light distribution, the large sheet S (e.g., the A3 extension size sheet) is available in the fixing device 150. Accordingly, the fixing device 150 includes the lateral end heater 112 constructed of downsized heaters, that is, the lateral end heaters 112*a* and 112*b* having a decreased width of about 20 mm in the axial direction of the fixing belt 80.

As the large sheet S (e.g., the A3 extension size sheet and the 13-inch sheet) is conveyed through the fixing nip N, the halogen heaters 82*a* and 82*b* and the lateral end heaters 112*a* and 112*b* are energized. Conversely, as the small sheet S (e.g., a sheet not greater than the A3 size sheet) is conveyed through the fixing nip N, the halogen heaters 82*a* and 82*b* are energized or the halogen heater 82*a* is energized. Hence, the lateral end heaters 112*a* and 112*b* are not energized. If the halogen heater 82*b* is configured to have an increased heating span to heat the large sheet S such as the A3 extension size sheet, the halogen heater 82*b* may heat the lateral end span of the fixing belt 80 unnecessarily while the large sheet S is not conveyed through the fixing nip N, wasting energy. To address this circumstance, the fixing device 150 according to this exemplary embodiment incorporates a simple mechanism in addition to the halogen heaters 82*a* and 82*b*, that is, the lateral end heaters 112*a* and 112*b* being disposed opposite both lateral end spans G in the axial direction of the fixing belt 80 or in proximity to both lateral ends of the fixing belt 80 in the axial direction thereof, respectively.

The lateral end heaters 112*a* and 112*b* may have a positive temperature coefficient (PTC) property. If the lateral end heaters 112*a* and 112*b* have the PTC property, a resistance value increases at a preset temperature or higher and the lateral end heaters 112*a* and 112*b* do not generate heat at the preset temperature or higher. Hence, the lateral end heaters 112*a* and 112*b* do not burn or damage the fixing belt 80, achieving the safe fixing device 150. Additionally, the lateral end heaters 112*a* and 112*b* situated inside the loop formed by the fixing belt 80 emit light that irradiates the inner circumferential surface of the fixing belt 80 to heat both lateral end spans G of the fixing belt 80 in the axial direction thereof without degrading rotation of the fixing belt 80.

Figure 7:
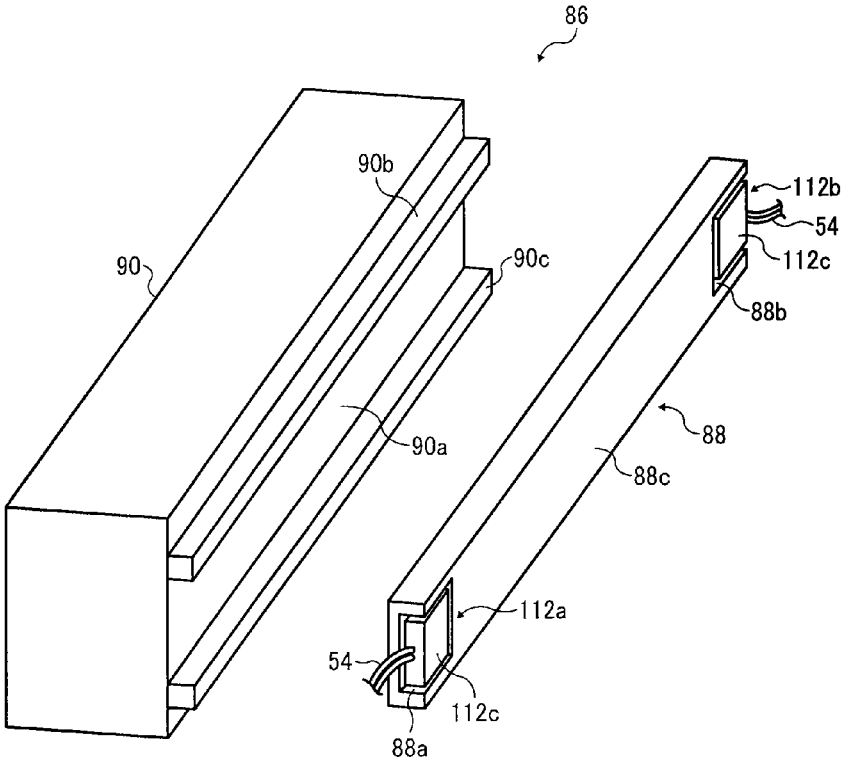
FIG. 7 is an exploded perspective view of a nip formation assembly incorporated in the fixing device shown in FIG. 2.

FIG. 7 is an exploded perspective view of the nip formation assembly 86. If a fixing belt side face 112*c* of the respective lateral end heaters 112*a* and 112*b* that contacts the inner circumferential surface of the fixing belt 80 is made of a smooth material different from a material of a body of the respective lateral end heaters 112*a* and 112*b*, the smooth material reduces the sliding friction of the fixing belt 80 as the fixing belt 80 slides over the lateral end heaters 112*a* and 112*b*, retaining stable rotation of the fixing belt 80.

As shown in FIG. 7, a side face 90*a* of the stay 90 that faces the pressure roller 84 mounts two ridges 90*b* and 90*c* extending in the axial direction of the fixing belt 80. The rectangular nip formation pad 88 is sandwiched and positioned between the two ridges 90*b* and 90*c* in the sheet conveyance direction DS and is attached to the side face 90*a* with an adhesive or the like. Thus, the side face 90*a* and the two ridges 90*b* and 90*c* accommodate the nip formation pad 88. Two recesses 88*a* and 88*b* that define a difference in thickness of the nip formation pad 88 are disposed at both lateral ends of the nip formation pad 88 in the longitudinal direction thereof. The lateral end heaters 112*a* and 112*b* are attached to the recesses 88*a* and 88*b* with an adhesive or the like or mounted on the recesses 88*a* and 88*b*, respectively, thus being accommodated by the recesses 88*a* and 88*b*. The nip formation pad 88 includes a nip formation face 88*c* that faces the pressure roller 84.

A description is provided of a construction of the lateral end heaters 112*a* and 112*b*.

Figure 8:
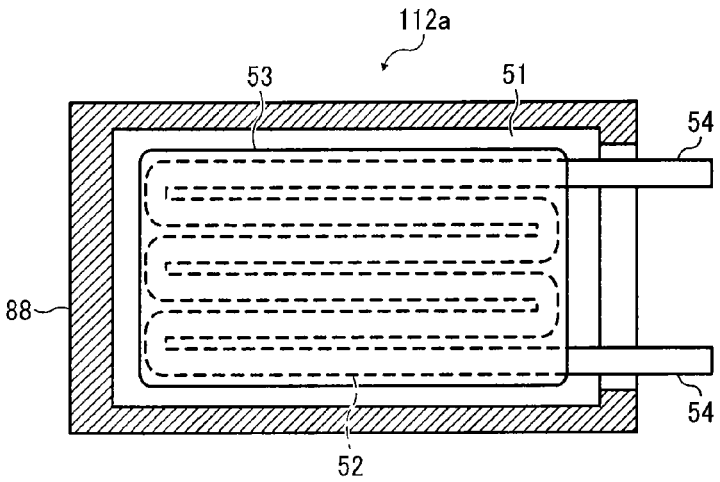
FIG. 8 is a plan view of the lateral end heater shown in FIG. 6.

FIG. 8 is a plan view of the lateral end heater 112*a*. Since the lateral end heaters 112*a* and 112*b* have an identical construction, FIG. 8 illustrates the lateral end heater 112*a*. The lateral end heater 112*a* includes a ceramic base 51, a resistive heat generator 52 layered on the base 51 with patterning, and an insulative layer 53 layered on the resistive heat generator 52. The base 51 has an outer size of about 10 mm×about 20 mm. The resistive heat generator 52 is a heat generator. The insulative layer 53 is a thin glass layer. Terminals 54, disposed at one lateral end of the lateral end heater 112*a* in the axial direction of the fixing belt 80, are connected to a power supply and a switching element.

As described above, the resistive heat generator 52 is mounted on a first face of the lateral end heater 112*a* so that the first face of the lateral end heater 112*a* that mounts the resistive heat generator 52 generates heat mainly while a second face of the lateral end heater 112*a* that does not mount the resistive heat generator 52 barely receives heat from the first face. According to this exemplary embodiment, the first face of the lateral end heater 112*a* that mounts the resistive heat generator 52 contacts the recess 88*a* depicted in FIG. 7. The terminals 54 are mounted on the first face of the lateral end heater 112*a*.

Figure 9:
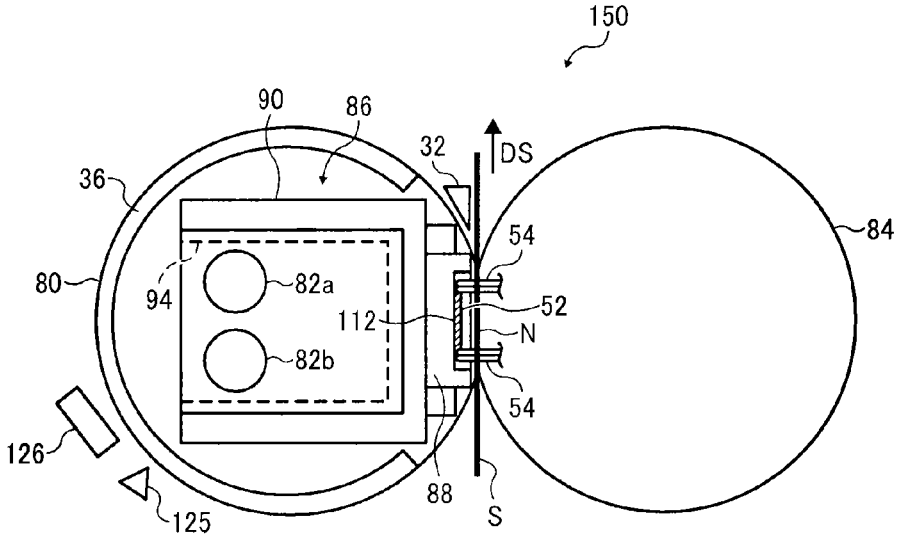
FIG. 9 is a schematic vertical sectional view of the fixing device illustrating the lateral end heater shown in FIG. 8.

FIG. 9 is a schematic vertical sectional view of the fixing device 150 illustrating the lateral end heater 112*a*. As shown in FIG. 9, the first face of the lateral end heater 112*a* that mounts the resistive heat generator 52 is isolated from the fixing belt 80. Accordingly, even if the insulative layer 53 depicted in FIG. 8 is broken, power supplied to the lateral end heater 112*a* is not transmitted to the fixing belt 80. If the fixing belt 80 is made of metal as described below, power may be transmitted to other components disposed inside the image forming apparatus 100 through metal of the fixing belt 80, for example, a thermistor contacting the fixing belt 80, thus adversely affecting the thermistor. To address this circumstance, the above-described configuration secures a predetermined interval between the inner circumferential surface of the fixing belt 80 and the resistive heat generator 52 extending along the inner circumferential surface of the fixing belt 80.

Figure 10A:
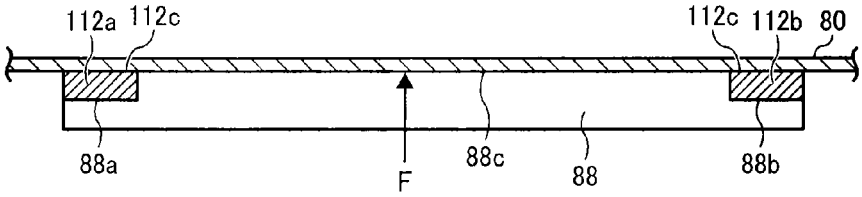
FIG. 10A is a sectional view of a fixing belt, a nip formation pad, and the lateral end heaters incorporated in the fixing device shown in FIG. 2 illustrating recesses of the nip formation pad.

FIG. 10A is a sectional view of the fixing belt 80, the nip formation pad 88, and the lateral end heaters 112*a* and 112*b*. As shown in FIG. 10A, each of the lateral end heaters 112*a* and 112*b* includes the fixing belt side face 112*c* contacting the inner circumferential surface of the fixing belt 80. The fixing belt side face 112*c* of the respective lateral end heaters 112*a* and 112*b* is leveled with the nip formation face 88*c* of the nip formation pad 88 in a pressurization direction F (e.g., a direction of a reaction force against pressure from the pressure roller 84) in which the nip formation pad 88 presses against the inner circumferential surface of the fixing belt 80. In other words, the fixing belt side face 112*c* contacting the inner circumferential surface of the fixing belt 80 defines an extension of the nip formation face 88*c* in the longitudinal direction of the nip formation pad 88. According to this exemplary embodiment, the lateral end heaters 112*a* and 112*b* are coupled with the nip formation pad 88 to form the fixing nip N. Hence, the lateral end heaters 112*a* and 112*b* are situated in a limited space inside the loop formed by the fixing belt 80, saving space.

The fixing belt side face 112*c* of the respective lateral end heaters 112*a* and 112*b* that contacts the inner circumferential surface of the fixing belt 80 is leveled with the nip formation face 88*c* of the nip formation pad 88 in the pressurization direction F to define an identical plane. Accordingly, the pressure roller 84 is pressed against the lateral end heaters 112*a* and 112*b* via the fixing belt 80 sufficiently. Consequently, the fixing belt 80 rotates in a state in which the fixing belt 80 adheres to the lateral end heaters 112*a* and 112*b*, improving conduction of heat from the lateral end heaters 112*a* and 112*b* to the fixing belt 80 and thereby retaining improved heating efficiency of the lateral end heaters 112*a* and 112*b*. Since the lateral end heaters 112*a* and 112*b* are situated within the fixing nip N in the axial direction of the fixing belt 80 to heat the fixing belt 80, the lateral end heaters 112*a* and 112*b* do not heat a portion of the fixing belt 80 that is outboard from the fixing nip N in the axial direction of the fixing belt 80, preventing residual toner failed to be fixed on the sheet S and therefore remaining on the fixing belt 80 from being melted again and adhered to the fixing belt 80. The pressure roller 84 also serves as a biasing member that presses the fixing belt 80 against the lateral end heaters 112*a* and 112*b* to adhere the fixing belt 80 to the lateral end heaters 112*a* and 112*b* so as to enhance conduction of heat from the lateral end heaters 112*a* and 112*b* to the fixing belt 80. Accordingly, a mechanism that presses the lateral end heaters 112*a* and 112*b* against the fixing belt 80 is not needed, simplifying the fixing device 150. In other words, pressure used to form the fixing nip N is also used to adhere the fixing belt 80 to the lateral end heaters 112*a* and 112*b*, improving conduction of heat from the lateral end heaters 112*a* and 112*b* to the fixing belt 80 without degrading rotation of the fixing belt 80.

Figure 10B:
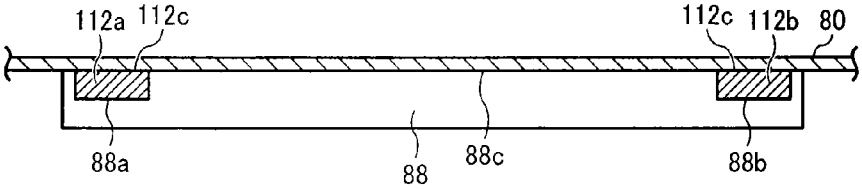
FIG. 10B is a sectional view of the fixing belt, the nip formation pad, and the lateral end heaters illustrating closed recesses as a first variation of the recesses shown in FIG. 10A.

As shown in FIG. 7, each of the recesses 88*a* and 88*b* is open at each lateral edge of the nip formation pad 88 in the longitudinal direction thereof. Alternatively, each of the recesses 88*a* and 88*b* may be closed and formed in a box defined by a bottom and four walls as shown in FIG. 10B. FIG. 10B is a sectional view of the fixing belt 80, the nip formation pad 88, and the lateral end heaters 112*a* and 112*b* illustrating the closed recesses 88*a* and 88*b* as a first variation of the recesses 88*a* and 88*b* shown in FIG. 10A. Alternatively, each of the recesses 88*a* and 88*b* may be closed at both ends in the axial direction of the fixing belt 80 and open at both ends in a direction perpendicular to the axial direction of the fixing belt 80.

Figure 11A:
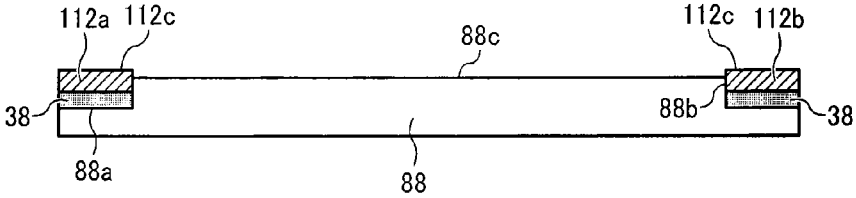
FIG. 11A is a sectional view of the nip formation pad and the lateral end heaters illustrating recesses as a second variation of the recesses shown in FIG. 10A.

FIG. 11A is a sectional view of the nip formation pad 88 and the lateral end heaters 112*a* and 112*b* illustrating the recesses 88*a* and 88*b* as a second variation of the recesses 88*a* and 88*b* shown in FIG. 10A. As shown in FIG. 11A, the recess 88*a* accommodates the lateral end heater 112*a* and an elastic member 38 supporting the lateral end heater 112*a*; the recess 88*b* accommodates the lateral end heater 112*b* and the elastic member 38 supporting the lateral end heater 112*b*. As shown in FIG. 11A, when the pressure roller 84 does not press the fixing belt 80 against the lateral end heaters 112*a* and 112*b*, the fixing belt side face 112*c* of the respective lateral end heaters 112*a* and 112*b* that contacts the inner circumferential surface of the fixing belt 80 is not leveled with the nip formation face 88*c* of the nip formation pad 88 in the pressurization direction F.

Figure 11B:
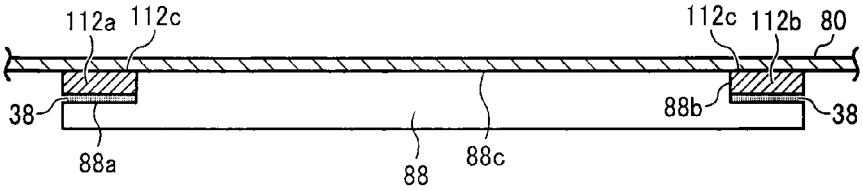
FIG. 11B is a sectional view of the fixing belt, the nip formation pad, and the lateral end heaters incorporated in the fixing device shown in FIG. 2 when a pressure roller presses the fixing belt against the lateral end heaters.

FIG. 11B is a sectional view of the fixing belt 80, the nip formation pad 88, and the lateral end heaters 112*a* and 112*b* when the pressure roller 84 presses the fixing belt 80 against the lateral end heaters 112*a* and 112*b*. As shown in FIG. 11B, when the pressure roller 84 presses the fixing belt 80 against the lateral end heaters 112*a* and 112*b* to form the fixing nip N, the elastic members 38 are deformed by pressure from the pressure roller 84 and the fixing belt side face 112*c* of the respective lateral end heaters 112*a* and 112*b* that contacts the inner circumferential surface of the fixing belt 80 is leveled with the nip formation face 88*c* of the nip formation pad 88 in the pressurization direction F. The elastic member 38 is made of rubber or includes a spring.

Since the lateral end heaters 112*a* and 112*b* are mounted and fixedly secured on the nip formation pad 88 as a separate component, the fixing belt side face 112*c* of the respective lateral end heaters 112*a* and 112*b* that contacts the inner circumferential surface of the fixing belt 80 may deviate from the nip formation face 88*c* of the nip formation pad 88 in height during assembly of the fixing device 150. To address this circumstance, the elastic members 38 support the lateral end heaters 112*a* and 112*b* to absorb a manufacturing error, thus leveling the fixing belt side face 112*c* of the respective lateral end heaters 112*a* and 112*b* with the nip formation face 88*c* of the nip formation pad 88 when the fixing nip N is formed.

Figure 12:
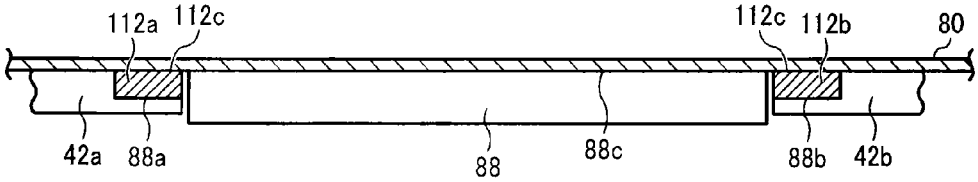
FIG. 12 is a sectional view of the fixing belt, the nip formation pad, and the lateral end heaters illustrating recesses as a third variation of the recesses shown in FIG. 10A.

According to this exemplary embodiment, the lateral end heaters 112*a* and 112*b* are coupled with the nip formation pad 88 to constitute the nip formation assembly 86. However, the lateral end heaters 112*a* and 112*b* may not be coupled with the nip formation pad 88 as shown in FIG. 12. FIG. 12 is a sectional view of the fixing belt 80, the nip formation pad 88, and the lateral end heaters 112*a* and 112*b* illustrating the recesses 88*a* and 88*b* as a third variation of the recesses 88*a* and 88*b* shown in FIG. 10A. As shown in FIG. 12, the lateral end heaters 112*a* and 112*b* are disposed outboard from the nip formation pad 88 in the longitudinal direction thereof and within the fixing nip N in the axial direction of the fixing belt 80. Thus, the lateral end heaters 112*a* and 112*b* are separated from the nip formation pad 88 or the nip formation assembly 86. For example, the lateral end heaters 112*a* and 112*b* are mounted on supports 42*a* and 42*b* mounted on the side plates 34 depicted in FIG. 5, respectively. As shown in FIG. 12, the fixing belt side face 112*c* of the respective lateral end heaters 112*a* and 112*b* that contacts the inner circumferential surface of the fixing belt 80 is leveled with the nip formation face 88*c* of the nip formation pad 88 in the pressurization direction F. Alternatively, the elastic members 38 depicted in FIGS. 11A and 11B may support the lateral end heaters 112*a* and 112*b* shown in FIG. 12, respectively, to displace the lateral end heaters 112*a* and 112*b*.

According to the exemplary embodiments described above, as shown in FIG. 2, the nip formation pad 88, the lateral end heaters 112*a* and 112*b*, the stay 90, and the halogen heaters 82*a* and 82*b* constitute the nip formation assembly 86. Alternatively, the nip formation pad 88 and the lateral end heaters 112*a* and 112*b* may constitute the nip formation assembly 86.

Figure 13:
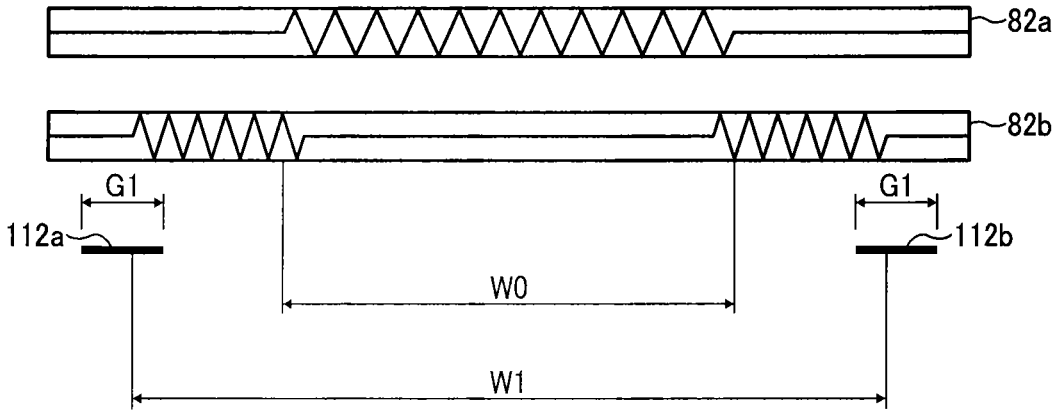
FIG. 13 is a plan view of the halogen heaters and the lateral end heaters shown in FIG. 6 illustrating a lateral end span of the lateral end heaters.

FIG. 13 is a plan view of the halogen heaters 82*a* and 82*b* and the lateral end heaters 112*a* and 112*b* spanning a lateral end span G1 in the axial direction of the fixing belt 80. FIG. 13 illustrates a width W0 of the A4 size sheet and the width W1 of the A3 size sheet in the axial direction of the fixing belt 80. As shown in FIG. 13, each of the lateral end heaters 112 *a* and 112*b* spans the lateral end span G1 in the axial direction of the fixing belt 80 to supplement decrease in heat output of an outboard part of the halogen heater 82*b* that suffers from a decreased heat output and heat the large sheet S such as the A3 extension size sheet.

The lateral end heaters 112*a* and 112*b* are disposed at both lateral ends of the fixing belt 80 in the axial direction thereof, respectively. Alternatively, a plurality of lateral end heaters 112*a* may be disposed at one lateral end of the fixing belt 80 in the axial direction thereof and a plurality of lateral end heaters 112*b* may be disposed at another lateral end of the fixing belt 80 in the axial direction thereof to correspond to sheets S of various sizes, for example.

Each of the lateral end heaters 112*a* and 112*b* may be disposed outboard from the halogen heater 82*b* in the axial direction of the fixing belt 80 in the axial direction thereof to correspond to sheets S of various sizes further and heat the fixing belt 80 precisely.

The lateral end heaters 112*a* and 112*b* having the PTC property may take an extended period of time to achieve a predetermined target temperature compared to the halogen heaters 82*a* and 82*b*. For example, if the lateral end heaters 112*a* and 112*b* and the halogen heaters 82*a* and 82*b* are energized simultaneously, the center span of the fixing belt 80 in the axial direction thereof is heated quickly, wasting energy. Further, as the sheets S conveyed over the fixing belt 80 draw heat from the fixing belt 80, the lateral end heaters 112*a* and 112*b*, due to their PTC property, take the extended period of time to retrieve the predetermined target temperature compared to the halogen heaters 82*a* and 82*b*.

To address this circumstance, the fixing device 150 decreases productivity to correspond to a heating cycle of the lateral end heaters 112*a* and 112*b*, thus controlling heating of the fixing belt 80 to reduce variation in temperature of the fixing belt 80 in the axial direction thereof, that is, between the center span and each lateral end span of the fixing belt 80 in the axial direction thereof. For example, while the lateral end heaters 112*a* and 112*b* that heat both lateral end spans G of the fixing belt 80 in the axial direction thereof or the vicinity of both lateral ends of the fixing belt 80, respectively, where the A3 extension size sheet is conveyed are energized, actuation of the halogen heaters 82*a* and 82*b* that heat an inboard span inboard from both lateral end spans G of the fixing belt 80 in the axial direction thereof where sheets smaller than the A3 extension size sheet are conveyed is controlled in accordance with temperature increase of both lateral end spans G of the fixing belt 80 in the axial direction thereof.

Accordingly, the fixing device 150 prevents waste of energy caused by the halogen heaters 82*a* and 82*b* that heat the inboard span of the fixing belt 80 in the axial direction thereof, where the sheets smaller than the large sheet S are conveyed, quickly and unnecessarily while the lateral end heaters 112*a* and 112*b* generate a decreased amount of heat. A conveyance speed at which the A3 extension size sheet heated by the lateral end heaters 112*a* and 112*b* is conveyed is smaller than a conveyance speed at which the sheets other than the A3 extension size sheet are conveyed. Thus, the fixing device 150 decreases productivity when the infrequently used, large sheet S (e.g., the A3 extension size sheet) is conveyed, simplifying the lateral end heaters 112*a* and 112*b* that heat both lateral end spans G of the fixing belt 80 in the axial direction thereof, respectively, and reducing manufacturing costs. Consequently, the fixing belt 80 is heated effectively. According to the exemplary embodiments described above, the fixing device 150 includes the two halogen heaters 82*a* and 82*b* serving as a fixing heater, respectively. Alternatively, the fixing device 150 may include three or more halogen heaters to correspond to various sizes of small sheets S.

A description is provided of a construction of a nip formation assembly 86S (e.g., a nip formation unit) as a variation of the nip formation assembly 86 depicted in FIG. 2.

Figure 14:
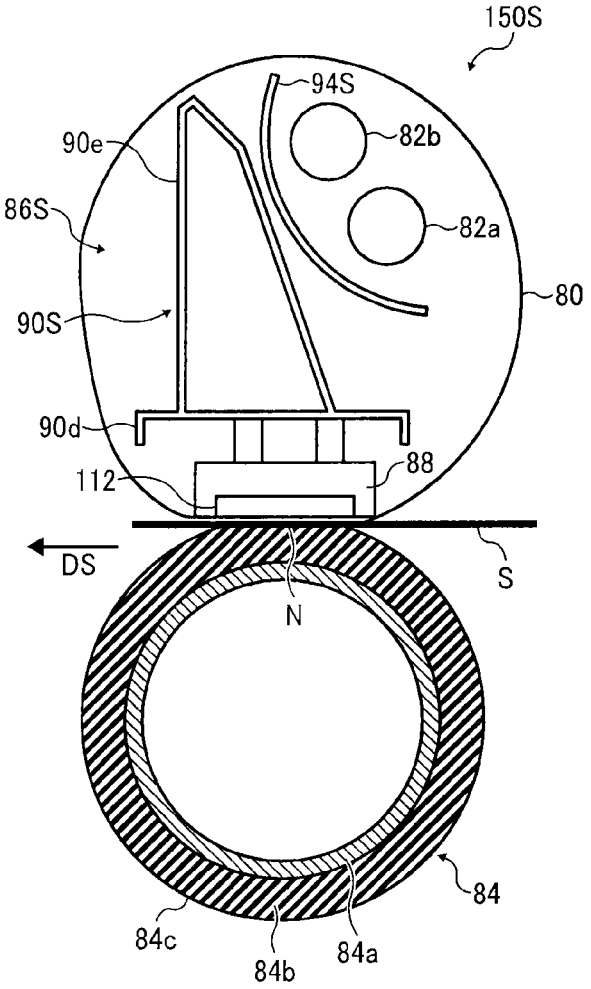
FIG. 14 is a schematic vertical sectional view of a fixing device incorporating a nip formation assembly as a variation of the nip formation assembly shown in FIG. 7.

FIG. 14 is a schematic vertical sectional view of a fixing device 150S (a fuser or a fusing unit) incorporating the nip formation assembly 86S. As shown in FIG. 14, the nip formation assembly 86S includes the nip formation pad 88, the lateral end heater 112 constructed of the lateral end heaters 112*a* and 112*b*, and a stay 90S that supports the nip formation pad 88 against pressure from the pressure roller 84. The stay 90S includes a base 90*d* and a stand 90*e* coupled with the base 90*d*. The base 90*d* supports the nip formation pad 88 like the stay 90 depicted in FIG. 2. The stand 90*e* is substantially contoured into a triangle in cross-section. The halogen heaters 82*a* and 82*b* serving as a fixing heater or a fixing heat source are interposed between the stand 90*e* of the stay 90S and the fixing belt 80. The halogen heaters 82*a* and 82*b* heat the fixing belt 80 directly with light irradiating the inner circumferential surface of the fixing belt 80, thus heating the fixing belt 80 with radiation heat. An arcuate, platy reflector 94S is interposed between the halogen heaters 82*a* and 82*b* and the stand 90*e* of the stay 90S to reflect light radiated from the halogen heaters 82*a* and 82*b* toward the fixing belt 80 so as to improve heating efficiency of the halogen heaters 82*a* and 82*b* to heat the fixing belt 80.

The nip formation assembly 86S achieves advantages similar to those of the nip formation assembly 86 described above. Alternatively, instead of the reflector 94S, an exterior surface of the stand 90*e* may be treated with insulation or mirror finish to reflect light radiated from the halogen heaters 82*a* and 82*b* toward the fixing belt 80. In this case, the halogen heaters 82*a* and 82*b* heat the fixing belt 80 with a slightly decreased heating efficiency compared to a heating efficiency with which the halogen heaters 82*a* and 82*b* heat the fixing belt 80 together with the reflector 94S.

A detailed description is now given of a construction of the fixing belt 80 made of metal.

The fixing belt 80 shown in FIGS. 2, 3, 9, and 14 conducts heat received from the halogen heaters 82*a* and 82*b* to the fixing nip N as the fixing belt 80 rotates in accordance with rotation of the pressure roller 84 contacting the outer circumferential surface of the fixing belt 80. Since the fixing belt 80 is exerted with a substantial load, the fixing belt 80 may have an insufficient mechanical strength if the fixing belt 80 is made of resin such as polyimide. To address this circumstance, the fixing belt 80 includes the base layer made of metal that achieves a sufficient mechanical strength, such as stainless steel, nickel, aluminum, and copper.

Figure 15:
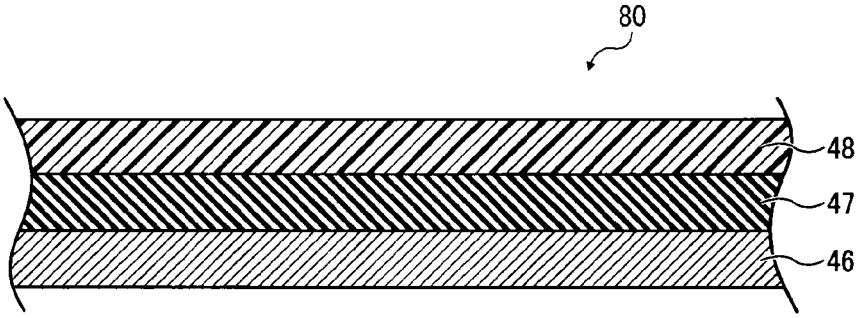
FIG. 15 is a sectional view of the fixing belt incorporated in the fixing device shown in FIGS. 2, 3, 9, and 14.

FIG. 15 is a sectional view of the fixing belt 80. As shown in FIG. 15 illustrating an example of a construction of the fixing belt 80, the fixing belt 80 includes a base layer 46 made of metal, an elastic layer 47 coating an outer circumferential surface of the base layer 46, and a release layer 48 coating an outer circumferential surface of the elastic layer 47. The base layer 46, the elastic layer 47, and the release layer 48 are layered by a typical method. The base layer 46 is requested to achieve durability, flexibility, and heat resistance to endure usage at the fixing temperature. The elastic layer 47 and the release layer 48 are also produced to achieve those durability, flexibility, and heat resistance. Nickel is more appropriate than stainless steel for the base layer 46 of the fixing belt 80 because nickel is superior to stainless steel in mechanical strength, durability, and readiness in manufacturing of the endless fixing belt 80 by an electroforming process.

A description is provided of an electric connection between the halogen heaters 82*a* and 82*b* and the lateral end heaters 112*a* and 112*b*.

Figure 16:
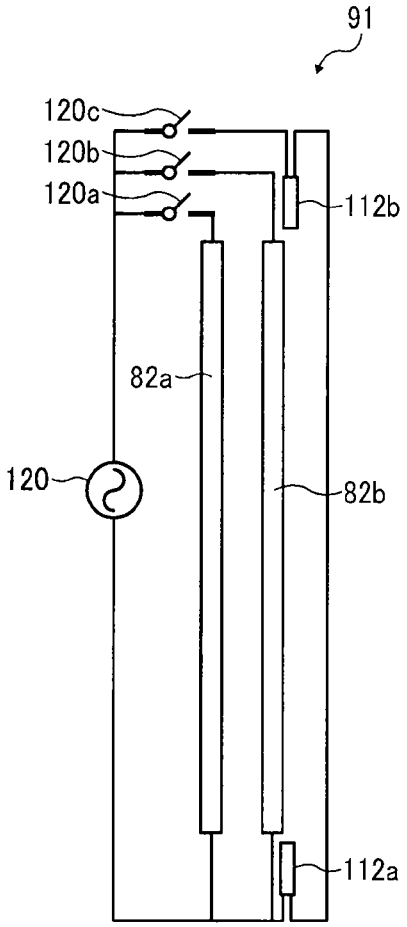
FIG. 16 is a diagram of an electric circuit showing an electric connection between the halogen heaters and the lateral end heaters of the fixing device shown in FIGS. 2, 9, and 14 according to a first exemplary embodiment of the present disclosure.
Figure 17:
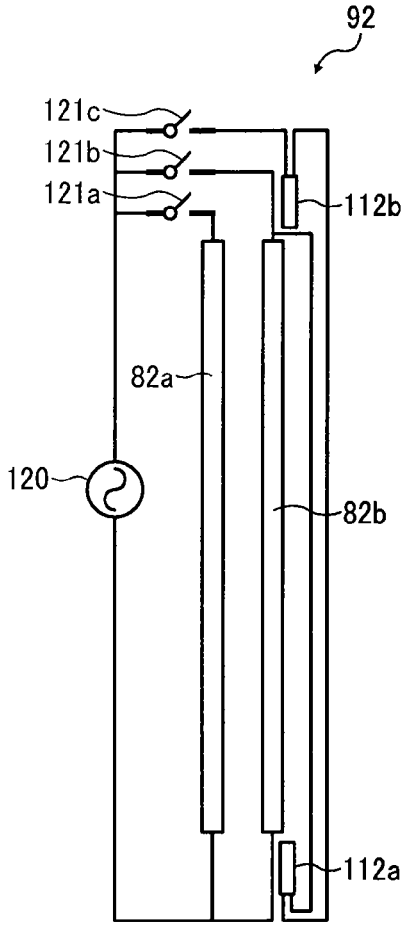
FIG. 17 is a diagram of an electric circuit showing the electric connection between the halogen heaters and the lateral end heaters of the fixing device shown in FIGS. 2, 9, and 14 according to a second exemplary embodiment of the present disclosure.

FIG. 16 is a diagram of an electric circuit 91 showing the electric connection between the halogen heaters 82*a* and 82*b* and the lateral end heaters 112*a* and 112*b* according to a first exemplary embodiment. FIG. 17 is a diagram of an electric circuit 92 showing the electric connection between the halogen heaters 82*a* and 82*b* and the lateral end heaters 112*a* and 112*b* according to a second exemplary embodiment. Under a center conveyance system in which the sheet S is centered in the axial direction of the fixing belt 80 as the sheet S is conveyed over the fixing belt 80, the lateral end heaters 112*a* and 112*b* are energized simultaneously. Accordingly, the lateral end heaters 112*a* and 112*b* are electrically connected in series to a power supply 120 as shown in FIG. 16. Consequently, the lateral end heaters 112*a* and 112*b* are electrically controlled more simply compared to a control in which the lateral end heater 112*a* is powered on and off separately from the lateral end heater 112*b*. If one of the lateral end heaters 112*a* and 112*b* suffers from failure, the power supply 120 interrupts electric connection between the lateral end heaters 112*a* and 112*b* simultaneously, achieving safety of the fixing device 150. The power supply 120 powers on and off the halogen heater 82*a* through a switch 120*a*, the halogen heater 82*b* through a switch 120*b*, and the lateral end heaters 112*a* and 112*b* through a switch 120*c*.

The lateral end heaters 112*a* and 112*b* are energized as the large sheet S greater than the A3 size sheet is conveyed through the fixing nip N. The halogen heater 82*b* directed to heat each lateral end span of the fixing belt 80 in the axial direction thereof is energized simultaneously. As shown in FIG. 17, according to the second exemplary embodiment, the halogen heater 82*b* is connected in series to the lateral end heaters 112*a* and 112*b*. Power supply to the halogen heaters 82*a* and 82*b* and the lateral end heaters 112*a* and 112*b* is controlled by switching a path with switches 121*a*, 121*b*, and 121*c*. Accordingly, a controller 99 depicted in FIG. 2 to control power supply to the halogen heaters 82*a* and 82*b* and the lateral end heaters 112*a* and 112*b* is simplified while attaining advantages similar to the advantages of the first exemplary embodiment described above. Since a temperature property of the halogen heater 82*b* is different from that of the lateral end heaters 112*a* and 112*b*, the temperature of the halogen heater 82*b* and the lateral end heaters 112*a* and 112*b* is adjusted by switching the path. For example, the controller 99 (e.g., a processor), that is, a central processing unit (CPU) provided with a random-access memory (RAM) and a read-only memory (ROM), is operatively connected to the halogen heaters 82*a* and 82*b* and the lateral end heaters 112*a* and 112*b*. The controller 99 may be disposed inside the fixing device 150 or the image forming apparatus 100.

As shown in FIGS. 16 and 17, as a small sheet S smaller than the A3 size sheet is conveyed through the fixing nip N, the switches 120*a* and 121*a* are turned on to energize the halogen heater 82*a*. As a medium sheet S greater than the small sheet S and not greater than the A3 size sheet is conveyed through the fixing nip N, the switches 120*a*, 121*a*, 120*b*, and 121*b* are turned on to energize the halogen heaters 82*a* and 82*b*. As a large sheet S greater than the A3 size sheet is conveyed through the fixing nip N, the switches 120*a*, 121*a*, 120*b*, and 121*b* are turned on and the switches 120*c* and 121*c* are turned on and off to power on the halogen heaters 82*a* and 82*b* and to power on and off the lateral end heaters 112*a* and 112*b* properly. According to the first exemplary embodiment shown in FIG. 16, the lateral end heaters 112*a* and 112*b* are electrically connected in parallel to each of the halogen heaters 82*a* and 82. Accordingly, the switches 120*a*, 120*b*, and 120*c* power on and off three parties, that is, the halogen heaters 82*a* as a first party, the halogen heater 82*b* as a second party, and the lateral end heaters 112*a* and 112*b* as a third party, separately from each other.

As shown in FIG. 2, the controller 99 controls the halogen heaters 82*a* and 82*b* and the lateral end heaters 112*a* and 112*b* through the electric circuits 91 and 92 based on the temperature of the fixing belt 80 detected by a temperature sensor 125 disposed opposite and in proximity to an outer circumferential surface of the fixing belt 80. A safety device such as a thermostat 126 is disposed opposite and in proximity to the outer circumferential surface of the fixing belt 80 to prevent the temperature sensor 125 from being out of control when the temperature sensor 125 suffers from failure. According to the second exemplary embodiment, the lateral end heaters 112*a* and 112*b* are energized simultaneously with energization of the halogen heater 82*b*. To address this circumstance, the thermostat 126 is disposed in proximity to the halogen heater 82*b* and disposed opposite and in proximity to the outer circumferential surface of the fixing belt 80 to detect failure of the lateral end heaters 112*a* and 112*b* simultaneously with detection of failure of the temperature sensor 125, thus simplifying the safety device.

On the other hand, according to the second exemplary embodiment, the lateral end heaters 112*a* and 112*b* are not energized separately from energization of the halogen heater 82*b*. Accordingly, if a heating performance of the lateral end heaters 112*a* and 112*b* is lower than that of the halogen heater 82*b*, a temperature of each lateral end span of the fixing belt 80 in the axial direction thereof that is heated by each of the lateral end heaters 112*a* and 112*b* is lower than a temperature of each lateral end span of the fixing belt 80 in the axial direction thereof that is heated by the halogen heater 82*b*. Consequently, the controller 99 may not eliminate a differential between the temperature of the lateral end span of the fixing belt 80 that is heated by the halogen heater 82*b* and the temperature of the lateral end span of the fixing belt 80 that is heated by the lateral end heaters 112*a* and 112*b*.

Figure 18:
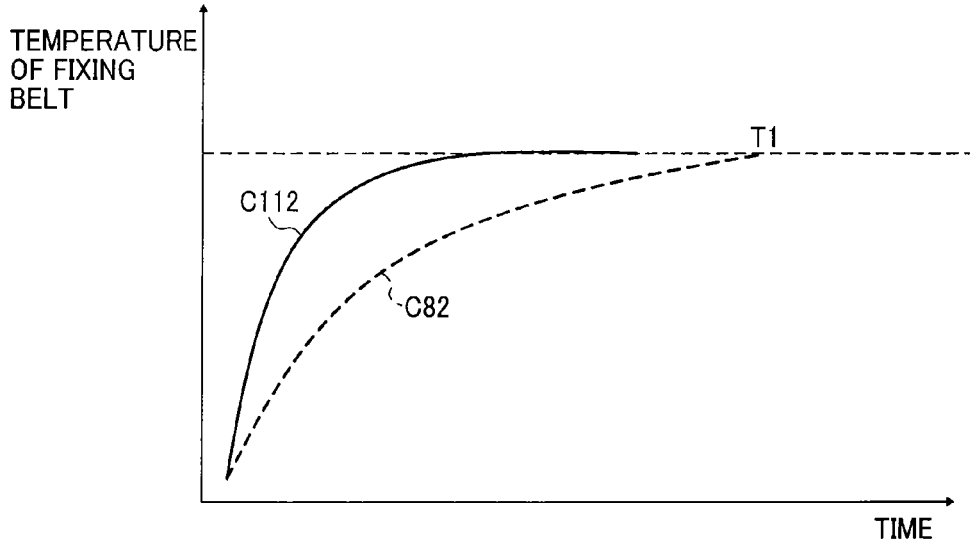
FIG. 18 is a graph showing a relation between time and a temperature of the fixing belt of the fixing device shown in FIG. 2.

To address this circumstance, according to the second exemplary embodiment, the controller 99 selectively energizes the halogen heater 82*b* and the lateral end heaters 112*a* and 112*b* such that the heating performance of the lateral end heaters 112*a* and 112*b* is higher than the heating performance of the halogen heater 82*b*. FIG. 18 is a graph showing a relation between time and the temperature of the fixing belt 80. As shown in FIG. 18, the controller 99 selectively energizes the halogen heater 82*b* and the lateral end heaters 112*a* and 112*b* such that a temperature increase property curve C112 of the lateral end heaters 112*a* and 112*b* indicated by a solid line increases more sharply than a temperature increase property curve C82 of the halogen heater 82*b* indicated by a dotted line, that is, such that the temperature of each lateral end span of the fixing belt 80 heated by the lateral end heaters 112*a* and 112*b* increases more quickly than the temperature of each lateral end span of the fixing belt 80 heated by the halogen heater 82*b*. If the switch 121*c* depicted in FIG. 17 is turned on under such condition, the temperature of the lateral end span of the fixing belt 80 in the axial direction thereof that is heated by the lateral end heaters 112*a* and 112*b* reaches a target temperature T1 depicted in FIG. 18 earlier than the temperature of the lateral end span of the fixing belt 80 in the axial direction thereof that is heated by the halogen heater 82*b*, attaining an increased temperature of the fixing belt 80. If the switch 121*c* is turned off and the switch 121*b* is turned on to even the temperature of the fixing belt 80 in the axial direction thereof and eliminate a differential between the temperature of the lateral end span of the fixing belt 80 that is heated by the lateral end heaters 112*a* and 112*b* and the temperature of the lateral end span of the fixing belt 80 that is heated by the halogen heater 82*b*, the halogen heater 82*b* heats the lateral end span of the fixing belt 80 to a temperature identical to the temperature of the lateral end span of the fixing belt 80 heated by the lateral end heaters 112*a* and 112*b* that reaches the target temperature T1 earlier.

According to the first exemplary embodiment, the lateral end heaters 112*a* and 112*b* are powered on and off separately from the halogen heater 82*b* and therefore the above control is not needed. Hence, the heating performance of the lateral end heaters 112*a* and 112*b* is allowed to be higher or lower than the heating performance of the halogen heater 82*b*. According to the first exemplary embodiment, flexibility in selective energization of the lateral end heaters 112*a* and 112*b* is improved compared to the second exemplary embodiment.

As described above, according to the first exemplary embodiment, even if the heating performance of the lateral end heaters 112*a* and 112*b* is lower than the heating performance of the halogen heater 82*b*, the controller 99 energizes the lateral end heaters 112*a* and 112*b* separately from the halogen heater 82*b*. Accordingly, the controller 99 controls the lateral end heaters 112*a* and 112*b* and the halogen heater 82*b* to cause the lateral end heaters 112*a* and 112*b* to heat both lateral end spans of the fixing belt 80 to a temperature identical to a temperature of both lateral end spans of the fixing belt 80 heated by the halogen heater 82*b*, thus improving flexibility in selective energization of the lateral end heaters 112*a* and 112*b* and the halogen heater 82*b*. According to the second exemplary embodiment, the thermostat 126 or the like serving as the safety device is disposed in proximity to the halogen heater 82*b* to detect failure of the temperature sensor 125 and prevent failure of the lateral end heaters 112*a* and 112*b* simultaneously, thus simplifying the safety device.

The image forming apparatuses, such a copier and a multifunction peripheral, incorporating the fixing device 150 or 150S provide a series of products by varying a linear velocity, a fixing temperature, fixing pressure, and the like in accordance with productivity defined by copies per minute (CPM) and pages per minute (PPM). Accordingly, the electric circuit 91 according to the first exemplary embodiment shown in FIG. 16 and the electric circuit 92 according to the second exemplary embodiment shown in FIG. 17 are selectively employed.

Figure 19:
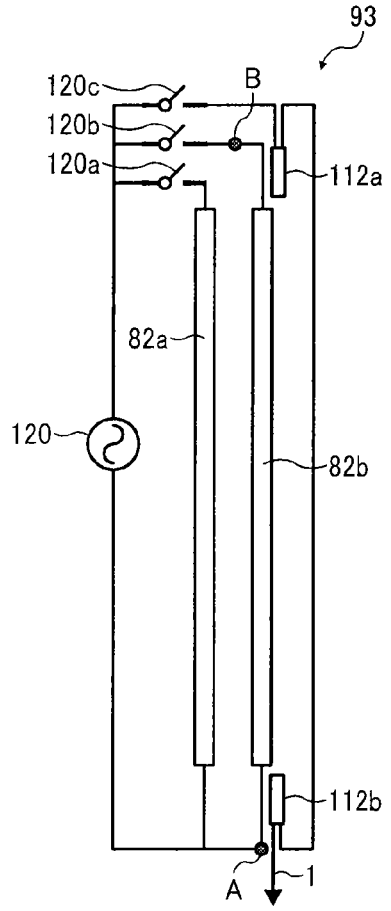
FIG. 19 is a diagram of an electric circuit according to a third exemplary embodiment of the present disclosure.

FIG. 19 is a diagram of an electric circuit 93 according to a third exemplary embodiment extracting a common wiring shared by the electric circuit 91 according to the first exemplary embodiment shown in FIG. 16 and the electric circuit 92 according to the second exemplary embodiment shown in FIG. 17. As shown in FIG. 19, a connector 1 connected to the lateral end heater 112*b* connected to the lateral end heater 112*a* in series is selectively connected to a contact A serving as a first contact interposed between the halogen heater 82*b* and the power supply 120 or a contact B serving as a second contact interposed between the switch 120*b* and the halogen heater 82*b* to readily switch between the electric circuit 91 according to the first exemplary embodiment and the electric circuit 92 according to the second exemplary embodiment. The connector 1 is connected to the contact A to produce the electric circuit 91 according to the first exemplary embodiment. The connector 1 is connected to the contact B to produce the electric circuit 92 according to the second exemplary embodiment.

With the fixing device 150 or 150S having the electric circuit 93 shown in FIG. 19, the connector 1 is selectively connected to the contact A or the contact B to switch between the electric circuits 91 and 92 readily. Accordingly, the series of products produced by varying a response, the linear velocity, and productivity of the lateral end heaters 112*a* and 112*b* share the common electric circuit 93 of the fixing device 150 or 150S, enhancing productivity.

The present disclosure is not limited to the details of the exemplary embodiments described above and various modifications and improvements are possible. The advantages achieved by the fixing device 150 or 150S are not limited to those described above.

A description is provided of advantages of the fixing devices 150 and 150S.

As shown in FIGS. 2 and 14, each of the fixing devices 150 and 150S includes a flexible endless belt (e.g., the fixing belt 80) and a pressure rotator (e.g., the pressure roller 84) disposed opposite the endless belt. A fixing heater (e.g., the halogen heaters 82*a* and 82*b*) heats at least a center span of a conveyance span in an axial direction of the endless belt where a recording medium (e.g., a sheet S) is conveyed. A nip formation pad (e.g., the nip formation pad 88) presses against the pressure rotator via the endless belt to form the fixing nip N between the endless belt and the pressure rotator. As the recording medium bearing a toner image is conveyed through the fixing nip N, the endless belt and the pressure rotator fix the toner image on the recording medium under heat and pressure.

As shown in FIGS. 6, 10A, 10B, 11A, 11B, and 13, two lateral end heaters (e.g., the lateral end heaters 112*a* and 112*b*), that is, a first lateral end heater and a second lateral end heater, are mounted on the nip formation pad. Each of the first lateral end heater and the second lateral end heater is disposed opposite a lateral end span (e.g., the lateral end spans G and G1) of an inner circumferential surface of the endless belt in the axial direction thereof that is disposed in proximity to a lateral end or a lateral edge of the endless belt in the axial direction thereof.

As shown in FIG. 16, the first lateral end heater and the second lateral end heater are electrically connected in series.

Accordingly, the first lateral end heater and the second lateral end heater are electrically controlled more simply compared to a configuration in which the first lateral end heater is powered on and off separately from the second lateral end heater. If one of the first lateral end heater and the second lateral end heater suffers from failure, the controller 99 depicted in FIG. 2 interrupts electric connection between the first lateral end heater and the second lateral end heater simultaneously, achieving safety of the fixing devices 150 and 150S.

According to the exemplary embodiments described above, the fixing belt 80 serves as an endless belt. Alternatively, a fixing film, a fixing sleeve, or the like may be used as an endless belt. Further, the pressure roller 84 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device, comprising:

a belt which is flexible and endless, and which is rotatable in a predetermined direction of rotation;

a pressure rotator disposed opposite the belt;

a nip formation pad to press against the pressure rotator via the belt to form a fixing nip between the belt and the pressure rotator, the fixing nip through which a recording medium bearing a toner image is conveyed;

a fixing heater disposed opposite at least a center span of a conveyance span of the belt in an axial direction thereof where the recording medium is conveyed to heat the belt;

a first lateral end heater mounted on the nip formation pad and disposed opposite a first lateral end span of an inner circumferential surface of the belt in the axial direction thereof to heat the belt;

a second lateral end heater mounted on the nip formation pad and disposed opposite a second lateral end span of the inner circumferential surface of the belt in the axial direction thereof to heat the belt, the second lateral end heater being electrically connected in series to the first lateral end heater; and a reflector having a mirror finish disposed between the fixing heater and the first lateral end heater, and disposed between the fixing heater and the second lateral end heater, to reflect heat from the fixing heater toward the belt in a direction other than towards the nip formation pad, wherein:

the fixing heater is a different type of heater and includes a different type of heat generation structure than the first lateral heater and the second lateral heater, the fixing heater is disposed away from the fixing nip, the nip formation pad includes a nip formation face to directly or indirectly contact the inner circumferential surface of the belt, and the first lateral end heater, the nip formation face of the nip formation pad, and the second lateral end heater are disposed in an order of the first lateral end heater, the nip formation face of the nip formation pad, and the second lateral end heater in the axial direction of the belt.

2. The fixing device according to claim 1, wherein each of the first lateral end heater and the second lateral end heater includes a belt side face disposed opposite the inner circumferential surface of the belt, the belt side face being leveled with the nip formation face of the nip formation pad in a pressurization direction in which the nip formation pad presses against the pressure rotator.

3. The fixing device according to claim 2, further comprising a slide sheet sandwiched between the inner circumferential surface of the belt and the nip formation face of the nip formation pad.

4. The fixing device according to claim 2, wherein the belt side face of each of the first lateral end heater and the second lateral end heater contacts the inner circumferential surface of the belt and defines an extension of the nip formation face of the nip formation pad.

5. The fixing device according to claim 1, further comprising:

a first switch to energize the fixing heater; and a power supply electrically connected in parallel to the fixing heater through the first switch, wherein the fixing heater is electrically connected in series to the first lateral end heater and the second lateral end heater.

6. The fixing device according to claim 5, further comprising:

a first contact interposed between the fixing heater and the power supply;

a second contact interposed between the first switch and the fixing heater; and a connector connected to the second lateral end heater and selectively connected to one of the first contact and the second contact.

7. The fixing device according to claim 5, further comprising a second switch to energize the first lateral end heater and the second lateral end heater.

8. The fixing device according to claim 7, wherein the first switch energizes the fixing heater in accordance with temperature increase of the first lateral end heater and the second lateral end heater after the second switch energizes the first lateral end heater and the second lateral end heater.

9. The fixing device according to claim 7, wherein the fixing heater includes:

a center heater disposed opposite the center span of the belt in the axial direction thereof; and an outboard heater disposed outboard from the center heater and disposed opposite each lateral end span of the belt in the axial direction thereof.

10. The fixing device according to claim 9, wherein the second switch de-energizes the first lateral end heater and the second lateral end heater and the first switch energizes the outboard heater when the first lateral end span of the belt heated by the first lateral end heater and the second lateral end span of the belt heated by the second lateral end heater are heated to a target temperature before each lateral end span of the belt heated by the outboard heater is heated to the target temperature.

11. The fixing device according to claim 9, wherein the outboard heater partially overlaps the first lateral end heater and the second lateral end heater in the axial direction of the belt.

12. The fixing device according to claim 9, wherein each of the first lateral end heater and the second lateral end heater is disposed outboard from the outboard heater in the axial direction of the belt.

13. The fixing device according to claim 9, further comprising:

a temperature sensor disposed opposite an outer circumferential surface of the belt to detect a temperature of the belt; and a thermostat disposed opposite the outer circumferential surface of the belt and disposed in proximity to the outboard heater to detect failure of the temperature sensor.

14. The fixing device according to claim 1, wherein the first lateral end heater and the second lateral end heater are electrically connected in parallel to the fixing heater.

15. The fixing device according to claim 1, wherein the first lateral end heater and the second lateral end heater are electrically connected to the fixing heater selectively in one of series and parallel.

16. An image forming apparatus, comprising:

an image bearer to bear a toner image; and a fixing device disposed downstream from the image bearer in a recording medium conveyance direction to fix the toner image on a recording medium, the fixing device including:

a belt which is flexible and endless, and which is rotatable in a predetermined direction of rotation;

a pressure rotator disposed opposite the belt;

a nip formation pad to press against the pressure rotator via the belt to form a fixing nip between the belt and the pressure rotator, the fixing nip through which the recording medium bearing the toner image is conveyed;

a fixing heater disposed opposite at least a center span of a conveyance span of the belt in an axial direction thereof where the recording medium is conveyed to heat the belt;

a first lateral end heater mounted on the nip formation pad and disposed opposite a first lateral end span of an inner circumferential surface of the belt in the axial direction thereof to heat the belt;

a second lateral end heater mounted on the nip formation pad and disposed opposite a second lateral end span of the inner circumferential surface of the belt in the axial direction thereof to heat the belt, the second lateral end heater being electrically connected in series to the first lateral end heater; and a reflector having a mirror finish disposed between the fixing heater and the first lateral end heater, and disposed between the fixing heater and the second lateral end heater, to reflect heat from the fixing heater toward the belt in a direction other than towards the nip formation pad, wherein:

the fixing heater is a different type of heater and includes a different type of heat generation structure than the first lateral heater and the second lateral heater, the fixing heater is disposed away from the fixing nip, the nip formation pad includes a nip formation face to directly or indirectly contact the inner circumferential surface of the belt, and the first lateral end heater, the nip formation face of the nip formation pad, and the second lateral end heater are disposed in an order of the first lateral end heater, the nip formation face of the nip formation pad, and the second lateral end heater in the axial direction of the belt.

17. The fixing device according to claim 1, wherein: the fixing heater comprises a halogen heater.

18. The fixing device according to claim 1, wherein:

the first and second lateral heaters each comprise a corresponding positive temperature coefficient (PTC) heater.

19. A fixing device, comprising:

a belt which is flexible and endless, and which is rotatable in a predetermined direction of rotation;

a pressure rotator disposed opposite the belt;

a nip formation pad to press against the pressure rotator via the belt to form a fixing nip between the belt and the pressure rotator, the fixing nip through which a recording medium bearing a toner image is conveyed;

a fixing heater disposed opposite at least a center span of a conveyance span of the belt in an axial direction thereof where the recording medium is conveyed to heat the belt;

a first lateral end heater mounted on the nip formation pad and disposed opposite a first lateral end span of an inner circumferential surface of the belt in the axial direction thereof to heat the belt;

a second lateral end heater mounted on the nip formation pad and disposed opposite a second lateral end span of the inner circumferential surface of the belt in the axial direction thereof to heat the belt, the second lateral end heater being electrically connected in series to the first lateral end heater; and a reflector having a mirror finish disposed between the fixing heater and the first lateral end heater, and disposed between the fixing heater and the second lateral end heater, to reflect heat from the fixing heater toward the belt in a direction other than towards the nip formation pad, wherein:

the fixing heater is a different type of heater and includes a different type of heat generation structure than the first lateral heater and the second lateral heater, the fixing heater is disposed away from the fixing nip, and the fixing heater comprises:

a first halogen heater to heat the center span of the conveyance span of the belt, a second halogen heater to heat the first and second lateral end spans of the conveyance span of the belt without heating the center span of the conveyance span of the belt.

* * * * *